US009705196B2

(12) United States Patent
Okunaga et al.

(10) Patent No.: US 9,705,196 B2
(45) Date of Patent: Jul. 11, 2017

(54) ANTENNA

(71) Applicants: Nippon Pillar Packing Co., Ltd., Osaka (JP); Fujitsu Ten Limited, Hyogo (JP)

(72) Inventors: Takeshi Okunaga, Osaka (JP); Akira Nakatsu, Osaka (JP); Eisuke Hayakawa, Hyogo (JP); Hiroaki Yoshitake, Hyogo (JP)

(73) Assignees: Nippon Pillar Packing Co., Ltd, Osaka (JP); Fujitsu Ten Limited, Hyogo (JP)

( * ) Notice: Subject to any disclaimer, the term of this patent is extended or adjusted under 35 U.S.C. 154(b) by 118 days.

(21) Appl. No.: 14/640,345

(22) Filed: Mar. 6, 2015

(65) Prior Publication Data

US 2015/0255870 A1 Sep. 10, 2015

(30) Foreign Application Priority Data

Mar. 7, 2014 (JP) ..... 2014-045261

(51) Int. Cl.
*H01Q 21/00* (2006.01)
*H01Q 9/04* (2006.01)
(Continued)

(52) U.S. Cl.
CPC ..... *H01Q 9/045* (2013.01); *H01Q 13/206* (2013.01); *H01Q 21/0075* (2013.01); *H01Q 21/065* (2013.01)

(58) Field of Classification Search
CPC . H01Q 13/206; H01Q 21/065; H01Q 21/0075
(Continued)

(56) References Cited

U.S. PATENT DOCUMENTS 5,422,649 A * 6/1995 Huang ..... H01Q 21/065 343/700 MS
7,079,079 B2 * 7/2006 Jo ..... H01Q 1/243 343/700 MS
(Continued)

FOREIGN PATENT DOCUMENTS

JP 2010-212946 A 9/2010
JP 2011-223050 11/2011
JP 2012-105072 5/2012

OTHER PUBLICATIONS

German Patent Application No. 10 2015 102 601.5; Office Action dated Jun. 30, 2015.

*Primary Examiner* — Dameon E Levi
*Assistant Examiner* — Hasan Islam
(74) *Attorney, Agent, or Firm* — Lewis Roca Rothgerber Christie LLP

(57) ABSTRACT

In an antenna, an antenna element interval is reduced without depending on an interval between converters, to widen the range of a phase folding angle to widen a detection angle range. The antenna includes a first antenna element including a feeder line extending from a first converter and a plurality of radiating elements. A second antenna element includes a feeder line extending from a second converter aligned together with the first converter and a plurality of radiating elements. The first and second antenna elements respectively include, at partial line portions of the feeder lines which extend from the converters to closest radiating elements, bend portions which are bent in directions which the bend portions come close to each other. The partial line portions of the first and second antenna elements are disposed so as to be linearly symmetrical about a virtual line.

10 Claims, 12 Drawing Sheets

(51) Int. Cl.
*H01Q 13/20* (2006.01)
*H01Q 21/06* (2006.01)

(58) Field of Classification Search
USPC ..... 343/853, 893
See application file for complete search history.

(56) References Cited

U.S. PATENT DOCUMENTS

| | | | | |
|---|---|---|---|---|
| 8,558,745 | B2 | 10/2013 | Habib et al. | |
| 2003/0218571 | A1* | 11/2003 | Yoon | H01Q 1/38 343/700 MS |
| 2012/0112976 | A1 | 5/2012 | Hayakawa et al. | |

* cited by examiner 10
11
13
14
20
21
23
24

ANTENNA

CROSS-REFERENCE TO RELATED APPLICATION

This application claims the priority benefit of Japanese patent application number JP2014-045261 filed Mar. 7, 2014, the entire disclosure of which is incorporated herein by reference.

BACKGROUND

Technical Field

The present invention relates to an antenna which detects an arrival angle of a radio wave (reflected wave) on the basis of a phase difference between radio waves received by two antenna elements.

Background Art

In recent years, an on-vehicle sensing device with a millimeter-wave radar has been put into practical use. In this device, a radio wave is transmitted from a transmitting antenna mounted on an own vehicle, a reflected wave of the radio wave from another vehicle is received, and the distance to the other vehicle, the relative speed relative to the other vehicle, and the azimuth of the other vehicle are measured on the basis of the reflected wave. Such a sensing device desirably has a wide-angle detection area in order to be able to detect the other vehicle over a wide range.

In order to measure the azimuth of the other vehicle, it is simply necessary to detect an arrival angle of the reflected wave, and as its detection method, a monopulse method based on a phase difference between radio waves received by two antenna elements (a phase monopulse method) is known. A receiving antenna for the monopulse method includes, for example, a plurality of antenna elements as shown in PATENT LITERATURE 1, and each antenna element includes a feeder line extending from a converter and a plurality of radiating elements which are fed with power from the feeder line.

CITATION LIST

Patent Literature

PATENT LITERATURE 1: Japanese Laid-Open Patent Publication No. 2010-212946

SUMMARY

Technical Problem

FIG. 12 is an explanatory diagram illustrating an example of a conventional receiving antenna for the monopulse method. The receiving antenna includes two antenna elements (a first antenna element 91 and a second antenna element 92). The first antenna element 91 includes a feeder line 93 extending from a first converter 101 and a plurality of radiating elements 94 which are fed with power from the feeder line 93, and the second antenna element 92 includes a feeder line 95 extending from a second converter 102 and a plurality of radiating elements 96 which are fed with power from the feeder line 95. The converters 101 and 102 are provided at end portions of waveguides 103 and 104, respectively, and the waveguides 103 and 104 are composed of, for example, square holes formed in a single aluminum block and are provided so as to be aligned in a lateral direction. It should be noted that the lateral direction is a direction perpendicular to a line extension direction in which the feeder lines 93 and 95 extend.

In order that the first and second converters 101 and 102 each have desired performance, both waveguides 103 and 104 are set to have a predetermined shape. In addition, in order to provide the two waveguides 103 and 104 in the single aluminum block such that the waveguides 103 and 104 are aligned in the lateral direction, it is necessary to provide a wall of about several millimeters between the waveguides 103 and 104 due to their processing limitations.

Thus, the interval between center lines of the waveguides 103 and 104 is increased, and an interval D1 between the converters 101 and 102 is also increased accordingly. As a result, an interval D2 between the feeder lines 93 and 95 which extend linearly from the converters 101 and 102, respectively, is also increased. That is, the interval between the antenna elements 91 and 92 depends on the interval between the converters 101 and 102 (the sizes and arrangements of the waveguides 103 and 104).

As described above, when the interval between the converters 101 and 102 is increased, the interval (phase center interval) between the first antenna element 91 and the second antenna element 92 is increased. As a result, in the case of a receiving antenna for the monopulse method, the range of an angle of phase folding by the first and second antenna elements 91 and 92 is narrowed, and it is difficult to widen a detection angle range. It should be noted that phase folding is a principled phenomenon of a monopulse method in which a plurality of phase differences are calculated for one azimuth (the arrival direction of a reflected wave).

Therefore, an object of the present invention is to provide an antenna which reduces an antenna element interval without depending on an interval between converters, to allow a range of a phase folding angle to be widened to widen a detection angle range.

Solution to Problem (1) An antenna of the present invention includes: a first antenna element including a feeder line extending from a first converter and a plurality of radiating elements which are fed with power from the feeder line; and a second antenna element including a feeder line extending from a second converter aligned together with the first converter and a plurality of radiating elements which are fed with power from the feeder line. The first antenna element and the second antenna element respectively include, at partial line portions of the feeder lines which partial line portions extend from the converters to the radiating elements that are closest to the converters, bend portions which are bent in directions in which the bend portions come close to each other. The partial line portion of the first antenna element and the partial line portion of the second antenna element are disposed so as to be linearly symmetrical about a virtual line which passes through a central point between the first converter and the second converter and is parallel to a line extension direction.

According to the present invention, it is possible to cause the feeder lines to come close to each other by the bend portions, to reduce the interval between the first antenna element and the second antenna element. Thus, it is possible to widen the range of a phase folding angle to widen a detection angle range. Furthermore, since the partial line portion of the first antenna element and the partial line portion of the second antenna element are disposed so as to be linearly symmetrical, it is possible to cause loss of power to the radiating element closest to the converter to be equal in the first antenna element and the second antenna element, the amount of radiation becomes equal between both antenna elements, and it is possible to make the detection distance equal between both antenna elements. Thus, it is possible to improve the range of angle detection.

(2) In each of the first antenna element and the second antenna element of the antenna of the above (1), the plurality of radiating elements may be disposed at both sides of a linear line portion which extends linearly from the partial line portion, and the radiating elements may be disposed such that, if the linear line portion of the first antenna element and the linear line portion of the second antenna element are overlapped with each other, the plurality of radiating elements of the first antenna element and the plurality of radiating elements of the second antenna element coincide with each other.

In this case, the front gain (sensitivity) is increased, and it is possible to obtain a gain close to a theoretical value. In addition, it is possible to cause the antenna characteristics of the first antenna element and the second antenna element to be the same, a process of obtaining a phase difference appearing between both antenna elements is made easy, and it is made possible to improve the accuracy of angle detection.

(3) In each of the first antenna element and the second antenna element of the antenna of the above (1), the plurality of radiating elements may be disposed at one side of a linear line portion which extends linearly from the partial line portion, and the radiating elements may be disposed such that, if the linear line portion of the first antenna element and the linear line portion of the second antenna element are overlapped with each other, the plurality of radiating elements of the first antenna element and the plurality of radiating elements of the second antenna element coincide with each other.

In this case, since the antenna shape formed by the linear line portion and the plurality of radiating elements which are fed with power from the linear line portion is the same between the first antenna element and the second antenna element, it is easy to obtain an intended phase difference between both antenna elements (i.e., a process of obtaining a phase difference is made easy), and it is made possible to improve the accuracy of angle detection.

(4) In the first antenna element of the antenna of the above (1), the plurality of radiating elements may be disposed at one side of a linear line portion extending linearly from the partial line portion which side is a side away from the second antenna element, and in the second antenna element, the plurality of radiating elements may be disposed at another side of a linear line portion extending linearly from the partial line portion which side is a side away from the first antenna element.

In this case, even when the interval between the linear line portion of the first antenna element and the linear line portion of the second antenna element is reduced, it is possible to ensure a sufficient interval between the radiating elements of both antenna elements, and it is possible to prevent a decrease in gain which is caused by electromagnetic coupling between the radiating elements.

(5) In the first antenna element of the antenna of the above (1), the plurality of radiating elements may be disposed at one side of a linear line portion extending linearly from the partial line portion which side is a side close to the second antenna element, and in the second antenna element, the plurality of radiating elements may be disposed at another side of a linear line portion extending linearly from the partial line portion which side is a side close to the first antenna element.

In this case, even when the interval between the linear line portion of the first antenna element and the linear line portion of the second antenna element is increased, it is possible to further reduce the interval (phase center interval) between the antenna elements by reducing the interval between the radiating elements of both antenna elements, and this can contribute to widening of the detection angle range.

(6) In any of the antennas of the above (1) to (5), a bending angle of the feeder line at the bend portion is preferably not greater than 75 degrees.

In this case, it is possible to reduce loss (radiation and reflection) caused by the bend of the feeder line.

Advantageous Effects of Invention

According to the present invention, it is possible to reduce the interval between the first antenna element and the second antenna element, and thus it is possible to widen the range of the phase folding angle to widen the detection angle range.

DETAILED DESCRIPTION

Hereinafter, embodiments of the present invention will be described with reference to the drawings. The following description is presented for purposes of illustration and description. It is not intended to be exhaustive or to limit the technology to the precise form disclosed. Many modifications and variations are possible in light of the teaching disclosed herein. The described embodiments were chosen in order to best explain the principles of the technology and its practical application to enable others skilled in the art to best utilize it in various embodiments and with various modifications as suited to the particular intended use and design considerations at issue.

Figure 1:
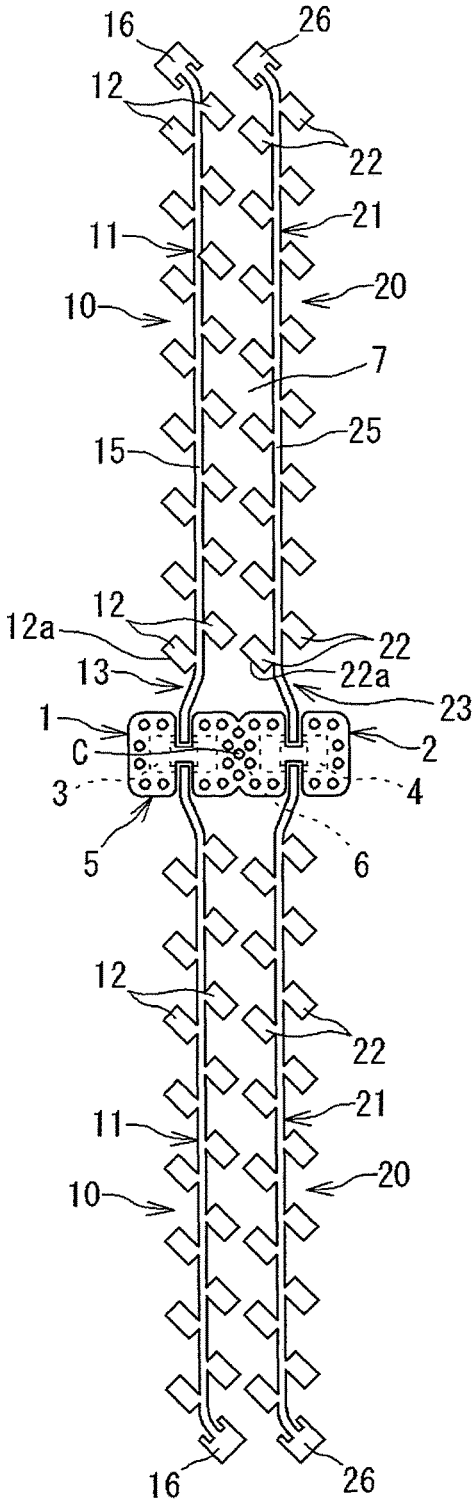
FIG. 1 is an explanatory diagram showing a schematic configuration of an antenna of the present invention.

An antenna of the present invention is a receiving antenna for a monopulse method, which detects an arrival angle of radio waves (reflected waves) on the basis of the phase difference between the radio waves received by two antenna elements. FIG. 1 is an explanatory diagram showing a schematic configuration of the receiving antenna of the present invention. The receiving antenna is an antenna which receives a reflected wave of a radio wave transmitted from a transmitting antenna which is not shown. In the present embodiment, the receiving antenna is composed of a microstrip antenna.

[First Embodiment]

The receiving antenna includes a first antenna element 10 and a second antenna element 20. The first antenna element 10 includes a feeder line 11 extending from a first converter 1 and a plurality of radiating elements 12 which are fed with power from the feeder line 11. The second antenna element 20 includes a feeder line 21 extending from a second converter 2 and a plurality of radiating elements 22 which are fed with power from the feeder line 21.

The first converter 1 and the second converter 2 are aligned in a lateral direction. It should be noted that the lateral direction is a direction perpendicular to a line extension direction in which the feeder lines 11 and 21 extend. In addition, in a state where the receiving antenna is installed, for example, on the body of a vehicle, the line extension direction is an up-down direction, and the lateral direction is a horizontal direction.

In the present embodiment, two first antenna elements 10, 10 are provided from the single first converter 1 toward both upper and lower sides, and two second antenna elements 20, 20 are provided from the single second converter 2 toward both upper and lower sides. In the following, a description will be given focusing on the two antenna elements 10 and 20 that extend upward from the converters 1 and 2 and are aligned in the lateral direction, as a pair of receiving antennas. It should be noted that a pair of the two antenna elements 10 and 20 that extend downward from the converters 1 and 2 and are aligned in the lateral direction have the same configuration as the above pair.

The first converter 1 and the second converter 2 have the same configuration, and the converters 1 and 2 are provided at end portions of waveguides 3 and 4, respectively. The waveguides 3 and 4 are composed of, for example, square holes formed in a single waveguide block (aluminum block) 5. A wall 6 which is composed of a part of the waveguide block 5 is provided between the waveguides 3 and 4. The first converter 1 performs mutual power conversion between the waveguide 3 and the feeder line 11 and is a feeding point for the feeder line 11. Similarly to this, the second converter 2 performs mutual power conversion between the waveguide 4 and the feeder line 21 and is a feeding point for the feeder line 21. The converters 1 and 2 are disposed adjacently to integrate the feeding points.

In the first antenna element 10, the feeder line 11 is a planar line and is composed of a conductive thin film formed on a dielectric substrate 7. The first converter 1 is provided at one end side of the feeder line 11. In addition, the feeder line 11 has a terminal element 16 at the other end thereof. The radiating elements 12 and the terminal element 16 are planar antennas and are composed of a conductive thin film formed on the dielectric substrate 7. In the present embodiment, the radiating elements 12 are provided at both sides of the feeder line 11 in the lateral direction, and a plurality of the radiating elements 12 are aligned in the line extension direction at each of both sides to form a row. The direction in which the radiating elements 12 of each row are aligned is parallel to the line extension direction.

Similarly to this, in the second antenna element 20, the feeder line 21 is a planar line and is composed of a conductive thin film formed on the dielectric substrate 7. The second converter 2 is provided at one end side of the feeder line 21. In addition, the feeder line 21 has a terminal element 26 at the other end thereof. The radiating elements 22 and the terminal element 26 are planar antennas and are composed of a conductive thin film formed on the dielectric substrate 7. In the present embodiment, the radiating elements 22 are provided at both sides of the feeder line 21 in the lateral direction, and a plurality of the radiating elements 22 are aligned in the line extension direction at each of both sides to form a row. The direction in which the radiating elements 22 of each row are aligned is parallel to the line extension direction.

The feeder line 11 of the first antenna element 10 includes a partial line portion 13 extending from the converter 1 to a radiating element 12*a* which is closest to the converter 1, and a linear line portion 15 extending linearly from the partial line portion 13.

In addition, the feeder line 21 of the second antenna element 20 includes a partial line portion 23 extending from the converter 2 to a radiating element 22*a* which is closest to the converter 2, and a linear line portion 25 extending linearly from the partial line portion 23.

Figure 2:
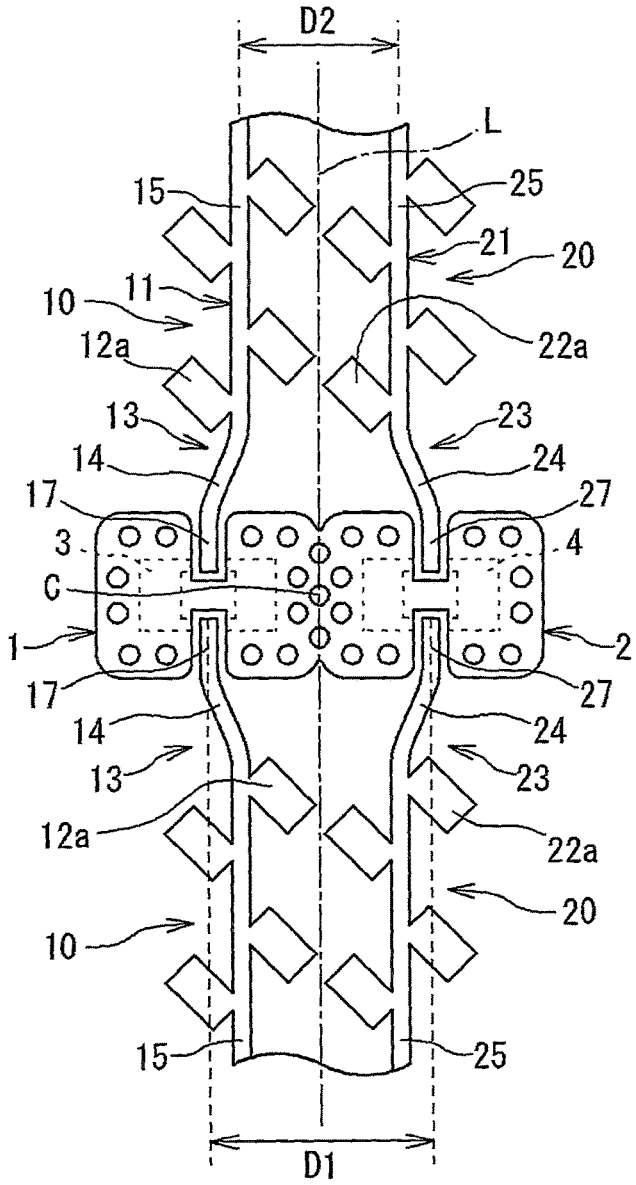
FIG. 2 is a diagram showing converters, partial line portions, and their surroundings.

FIG. 2 is a diagram showing the converters 1 and 2, the partial line portions 13 and 23, and their surroundings. In FIG. 2, the partial line portion 13 in the first antenna element 10 and the partial line portion 23 in the second antenna element 20 include bend portions 14 and 24 which are bent in directions in which the bend portions 14 and 24 come close to each other.

That is, the partial line portion 13 in the first antenna element 10 includes a feed terminal portion 17 composed of a linear line extending in the up-down direction from the converter 1, and the bend portion 14 is a portion which is bent from the feed terminal portion 17 in a direction in which the portion comes close to the second antenna element 20 (bend portion 24) and extends toward the radiating elements 12 side. The bend portion 14 is connected to the linear line portion 15. In addition, the partial line portion 23 in the second antenna element 20 includes a feed terminal portion 27 composed of a linear line extending in the up-down direction from the converter 2, and the bend portion 24 is a portion which is bent from the feed terminal portion 27 in a direction in which the portion comes close to the first antenna element 10 (bend portion 14) and extends toward the radiating elements 22 side. The bend portion 24 is connected to the linear line portion 25. In the present embodiment, the bend shapes of the bend portions 14 and 24 are shapes bent so as to be curved.

Furthermore, as shown in FIG. 2, the partial line portion 13 of the first antenna element 10 and the partial line portion 23 of the second antenna element 20 are disposed so as to be linearly symmetrical about a virtual line L which passes through a central point C between the first converter 1 and the second converter 2 and is parallel to the line extension direction. Thus, the bend portions 14 and 24 are also linearly symmetrical about the virtual line L, and the bent position and the degree of bending (bending angle) of the bend portion 14 are the same as the bent position and the degree of bending (bending angle) of the bend portion 24.

As described above, the first antenna element 10 and the second antenna element 20 include the bend portions 14 and 24 which are bent in the directions in which the bend portions 14 and 24 come close to each other, at the partial line portions 13 and 23 of the feeder lines 11 and 21 which extend from the converters 1 and 2 to the radiating elements 12*a* and 22*a* which are closest to the converters 1 and 2, respectively.

Figure 12:
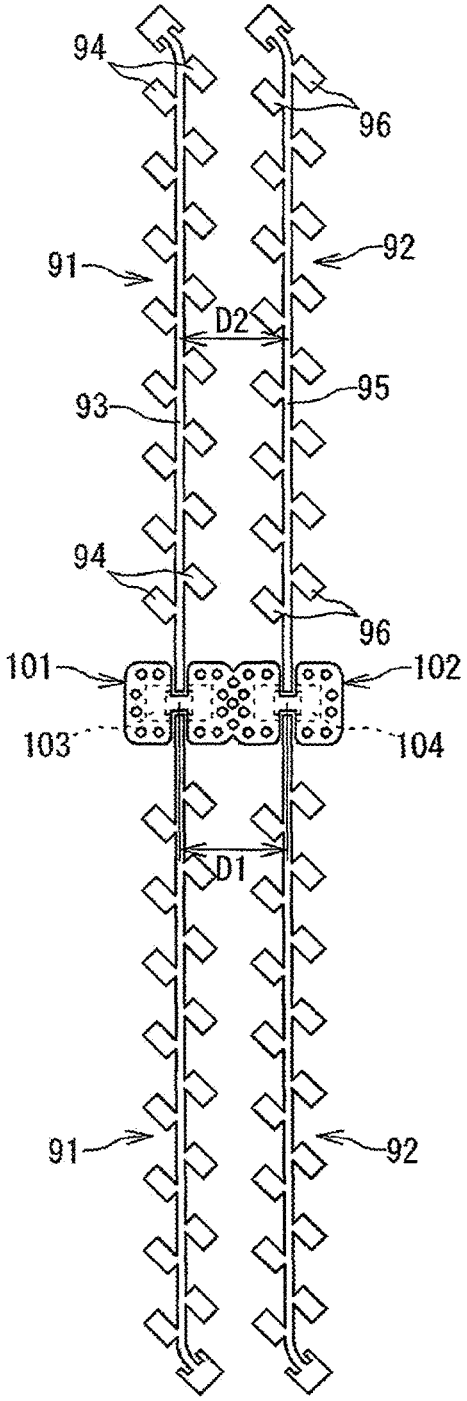
FIG. 12 PRIOR ART
FIG. 12 is an explanatory diagram illustrating an example of a conventional receiving antenna for a monopulse method.

With the bend portions 14 and 24, it is possible to cause the feeder lines 11 and 21 (linear line portions 15 and 25) to come close to each other, and it is possible to cause an interval D2 between the first antenna element 10 and the second antenna element 20 to be smaller than that in the conventional art (see FIG. 12). Thus, in the case where an arrival direction of a received radio wave is detected by a monopulse method with the receiving antenna including the two antenna elements 10 and 20, phase folding appears, but it is possible to widen the range of an angle of the phase folding (a phase folding angle) to widen a detection angle range. The principle of detecting the arrival angle of the reflected wave by the monopulse method will be briefly described later.

The interval D2 is a phase center interval between the first antenna element 10 and the second antenna element 20, and is the interval between an electrical phase center line of the first antenna element 10 and an electrical phase center line of the second antenna element 20. Each electrical phase center line is a straight line parallel to the virtual line L. In the present embodiment, the electrical phase center line of the first antenna element 10 is a straight line passing through the centroid (center of gravity) of the first antenna element 10 (the feeder line 11, the terminal element 16, and the radiating elements 12), and the electrical phase center line of the second antenna element 20 is a straight line passing through the centroid (center of gravity) of the second antenna element 20 (the feeder line 21, the terminal element 26, and the radiating elements 22).

The interval D2 is smaller than an interval D1 between the converters 1 and 2. The interval D1 between the converters 1 and 2 is equal to a center interval between the waveguides 3 and 4.

Furthermore, since the partial line portion 13 of the first antenna element 10 and the partial line portion 23 of the second antenna element 20 are disposed so as to be linearly symmetrical about the virtual line L, it is possible to cause loss of power to the radiating elements 12*a* and 22*a*, which are closest to the converters 1 and 2, to be equal in the first antenna element 10 and the second antenna element 20, the amount of radiation becomes equal between the antenna elements 10 and 20, and it is possible to make the detection distance equal between the antenna elements 10 and 20. Thus, it is possible to improve the range of angle detection.

In particular, in the embodiment shown in FIGS. 1 and 2, in each of the first antenna element 10 and the second antenna element 20, the plurality of the radiating elements 12 or 22 are disposed at both sides of the linear line portion 15 or 25, and the radiating elements 12 and 22 are disposed such that, if the linear line portion 15 of the first antenna element 10 and the linear line portion 25 of the second antenna element 20 are moved parallel in the lateral direction to be overlapped with each other, the plurality of the radiating elements 12 of the first antenna element 10 and the plurality of the radiating elements 22 of the second antenna element 20 coincide with each other (coincide with each other in both shape and arrangement).

Therefore, according to the receiving antenna, it is possible to cause the antenna characteristics of the first antenna element 10 and the second antenna element 20 to be the same. That is, the electrical lengths of the radiating elements 12 and 22 of the first antenna element 10 and the second antenna element 20 become the same, whereby the antenna characteristics of the first antenna element 10 and the second antenna element 20 become the same. Thus, a process of obtaining a phase difference appearing between the antenna elements 10 and 20 is made easy, and it is made possible to improve the accuracy of angle detection.

In addition, according to the receiving antenna, the front gain (receiving sensitivity) is increased, and it is possible to obtain a gain close to a theoretical value.

[Second Embodiment]

Figure 3:
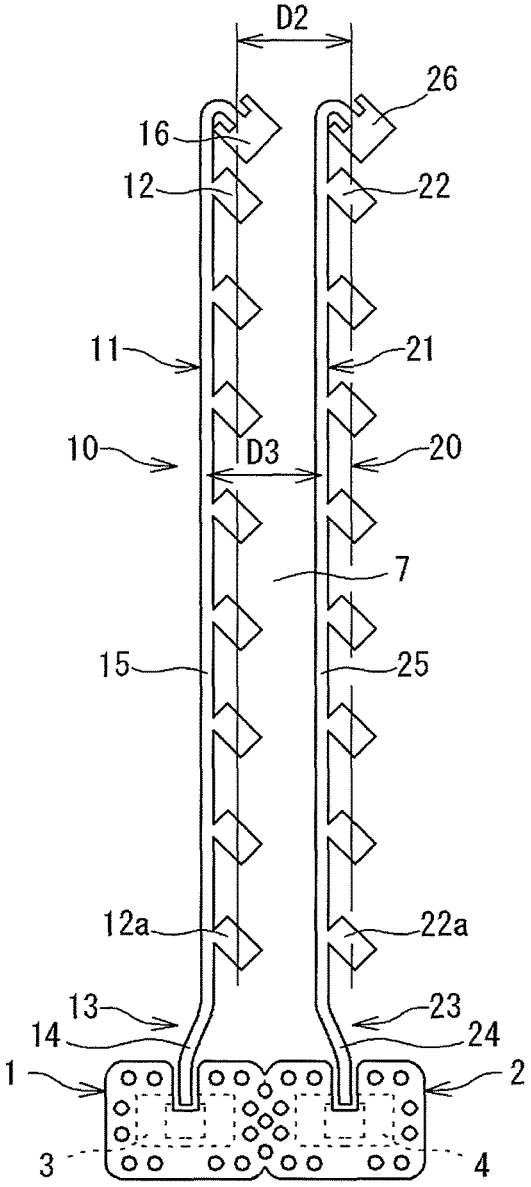
FIG. 3 is an explanatory diagram showing a schematic configuration of another embodiment of the receiving antenna.

FIG. 3 is an explanatory diagram showing a schematic configuration of another embodiment of the receiving antenna. The receiving antenna shown in FIG. 3 is different from the receiving antenna shown in FIG. 1 in only the arrangements of the radiating elements 12 and 22, and the other portion thereof is the same as the receiving antenna shown in FIG. 1. It should be noted that an interval D3 between the linear line portion 15 of the first antenna element 10 and the linear line portion 25 of the second antenna element 20 and the phase center interval D2 between the first antenna element 10 and the second antenna element 20 may be made further smaller than those in the receiving antenna shown in FIG. 1.

That is, in the receiving antenna shown in FIG. 3, the plurality of the radiating elements 12 which belong to the first antenna element 10 are disposed at only one side of the linear line portion 15, and the plurality of the radiating elements 22 which belong to the second antenna element 20 are disposed at only one side of the linear line portion 25. The one sides at which the radiating elements 12 and 22 are provided are the same side (the right side in FIG. 3) relative to the linear line portions 15 and 25.

The radiating elements 12 and 22 are disposed such that, if the linear line portion 15 of the first antenna element 10 and the linear line portion 25 of the second antenna element 20 are moved parallel in the lateral direction to be overlapped with each other, the plurality of the radiating elements 12 of the first antenna element 10 and the plurality of the radiating elements 22 of the second antenna element 20 coincide with each other (coincide with each other in both shape and arrangement).

According to the receiving antenna, the antenna shape formed by the linear line portion 15 of the first antenna element 10 and the plurality of the radiating elements 12, which are fed with power from the linear line portion 15, and the antenna shape formed by the linear line portion 25 of the second antenna element 20 and the plurality of the radiating elements 22, which are fed with power from the linear line portion 25, are the same. That is, the electrical lengths of the radiating elements 12 and 22 of the first antenna element 10 and the second antenna element 20 become the same, whereby the antenna characteristics of the first antenna element 10 and the second antenna element 20 become the same. Thus, it is easy to obtain an intended phase difference between both antenna elements 10 and 20 (that is, a process of obtaining a phase difference is made easy), and it is made possible to improve the accuracy of angle detection.

[Third Embodiment]

Figure 4:
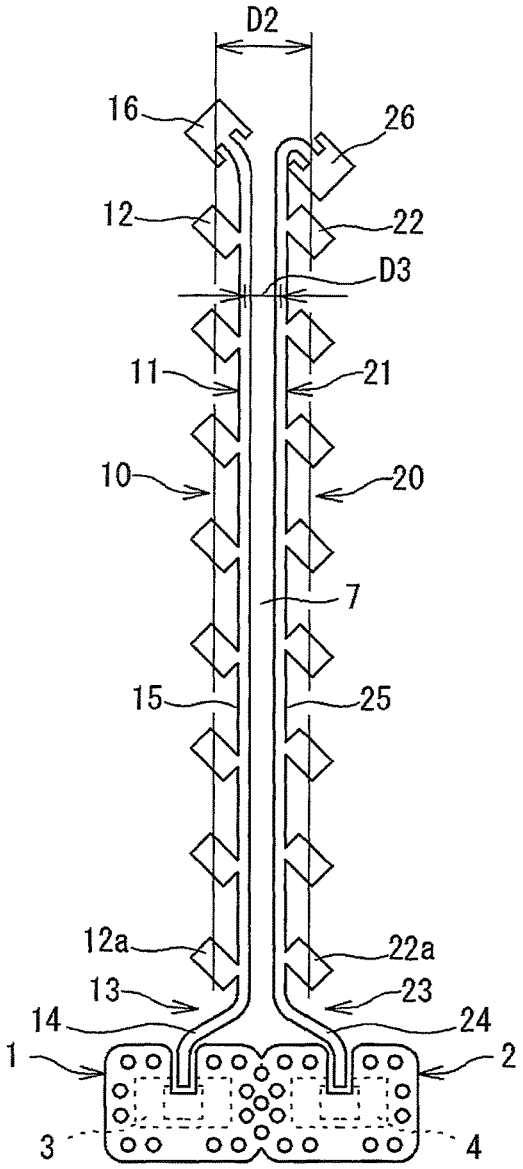
FIG. 4 is an explanatory diagram showing a schematic configuration of still another embodiment of the receiving antenna.

FIG. 4 is an explanatory diagram showing a schematic configuration of still another embodiment of the receiving antenna. The receiving antenna shown in FIG. 4 is different from the receiving antennas of the other embodiments in the arrangements of the radiating elements 12 and 22, but the other portion thereof is the same as the receiving antennas of the other embodiments.

That is, in the receiving antenna shown in FIG. 4, the plurality of the radiating elements 12 which belong to the first antenna element 10 are disposed at only one side of the linear line portion 15 which side is a side away from the second antenna element 20, and the plurality of the radiating elements 22 which belong to the second antenna element 20 are disposed at only the other side of the linear line portion 25 which side is a side away from the first antenna element 10. The radiating elements 12 and 22 are disposed outward of the linear line portions 15 and 25, not between the linear line portions 15 and 25.

According to the receiving antenna, it is possible to further reduce the interval D3 between the linear line portion 15 of the first antenna element 10 and the linear line portion 25 of the second antenna element 20. In addition, even when the interval D3 between the linear line portion 15 of the first antenna element 10 and the linear line portion 15 of the second antenna element 20 is reduced, it is possible to ensure a sufficient interval between the radiating elements 12 and 22 of both antenna elements 10 and 20, and it is possible to prevent a decrease in gain which is caused by electromagnetic coupling between the radiating elements 12 and 22.

[Fourth Embodiment]

Figure 5:
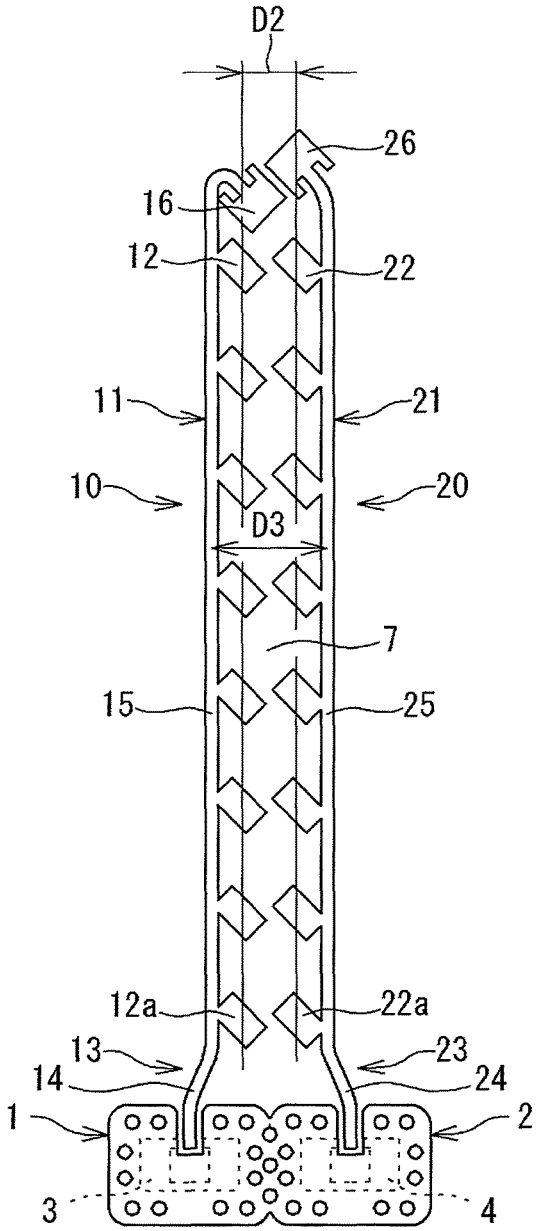
FIG. 5 is an explanatory diagram showing a schematic configuration of still another embodiment of the receiving antenna.

FIG. 5 is an explanatory diagram showing a schematic configuration of still another embodiment of the receiving antenna. The receiving antenna shown in FIG. 5 is different from the receiving antennas of the other embodiments in the arrangements of the radiating elements 12 and 22, but the other portion thereof is the same as the receiving antennas of the other embodiments.

That is, in the receiving antenna shown in FIG. 5, the plurality of the radiating elements 12 which belong to the first antenna element 10 are disposed at only one side of the linear line portion 15 which side is a side close to the second antenna element 20, and the plurality of the radiating elements 22 which belong to the second antenna element 20 are disposed at only the other side of the linear line portion 25 which side is a side close to the first antenna element 10. The radiating elements 12 and 22 are disposed at the inner side which is between the linear line portions 15 and 25.

According to the receiving antenna, by causing the interval D3 between the linear line portion 15 of the first antenna element 10 and the linear line portion 25 of the second antenna element 20 to be smaller than that in the conventional art (see FIG. 12) to reduce the interval between the radiating elements 12 and 22 of both antenna elements 10 and 20, it is possible to reduce the phase center interval D2, and this can contribute to widening of the detection angle range.

[Regarding Receiving Antenna of Each Embodiment]

In addition to the receiving antennas shown in FIGS. 1 and 3, in each of the receiving antennas shown in FIGS. 4 and 5, when the radiating elements 12 which belong to the first antenna element 10 and the radiating elements 22 which belong to the second antenna element 20 are focused on regarding their positions in the up-down direction, the radiating elements 12 and the radiating elements 22 are arranged at the same positions, and if only a row of the radiating elements 12 and the terminal element 16 and a row of the radiating elements 22 and the terminal element 26 are moved parallel in the lateral direction to be overlapped with each other, the plurality of the radiating elements 12 and the plurality of the radiating elements 22 have a relationship in which the radiating elements 12 and 22 coincide with each other.

Figure 6A:
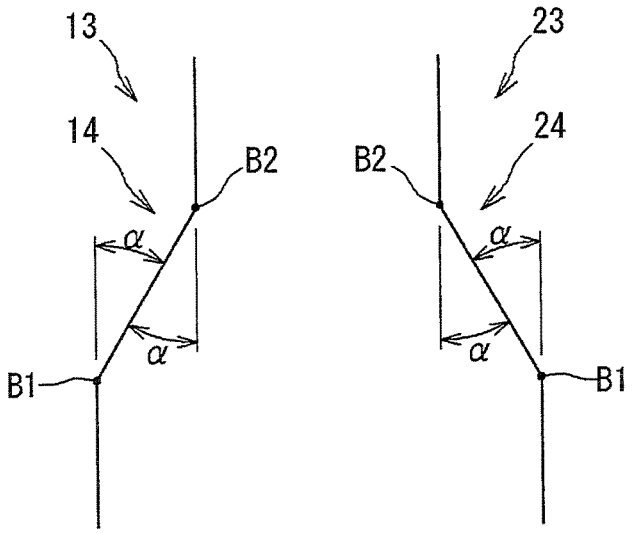
FIGS. 6A and 6B are each a line diagram of bend portions.
Figure 6B:
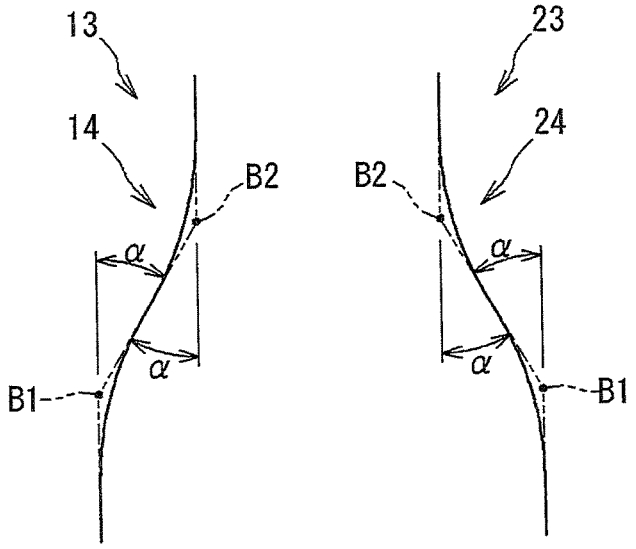

FIGS. 6A and 6B are each a line diagram of the bend portions 14 and 24 included in the partial line portions 13 and 23 of the feeder lines 11 and 21. Each of the bend portions 14 and 24 has bend middle points B1 and B2 at two locations. Each of the bend portions 14 and 24 shown in FIG. 6A is composed of linear lines. In this case, the intersections of these lines are the middle points B1 and B2.

Alternatively, as shown in FIG. 6B, each of the bend portions 14 and 24 is configured to include curved lines. In this case, the intersections of linear lines at both sides of the curved lines are the middle points B1 and B2.

In FIGS. 6A and 6B, the bending angles $\alpha$ of the feeder lines 11 and 21 at the bend portions 14 and 24, that is, the bending angles $\alpha$ of the lines at the middle points B1 and B2 are preferably not greater than 75 degrees ($\alpha \leq 75$ degrees).

Figure 7:
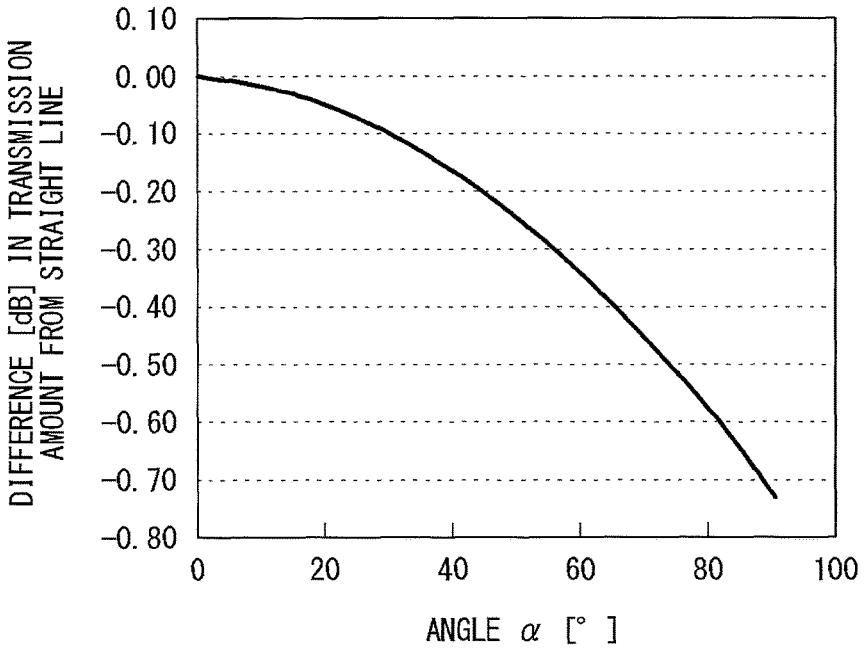
FIG. 7 is a graph having a vertical axis indicating the difference in transmission amount between a linear feeder line and a feeder line including a bend portion and a horizontal axis indicating a bending angle at the bend portion.

Here, FIG. 7 is a graph having a vertical axis indicating the difference [dB] in transmission amount between a feeder line which is entirely linear and a feeder line including the bend portion 14 (24) and a horizontal axis indicating a bending angle $\alpha$ at the bend portion 14 (24). As shown in FIG. 7, the transmission amount decreases as the bending angle $\alpha$ increases.

In particular, when the bending angle $\alpha$ exceeds 75 degrees, the difference becomes −0.5 [dB], and loss of radiation, reflection, or the like caused by the bend portion 14 (24) is increased.

In addition, according to FIG. 7, the bending angle $\alpha$ is particularly preferably not greater than 30 degrees ($\alpha \leq 30$ degrees). When the bending angle $\alpha$ is in the range of not greater than 30 degrees, the difference is small, and it is possible to reduce the loss of radiation, reflection, or the like caused by the bend portion 14 (24).

Here, a specific example of the receiving antenna will be described. The frequency of a radio wave to be used is set to 76.5 [GHz].

In the receiving antenna in FIGS. 1 and 2, in the case where the waveguides 3 and 4 having 3.1 millimeters in width and 1.55 millimeters in length are provided and the wall 6 having a thickness of 1 millimeter is formed in the waveguide block 5, the interval D1 between the converters 1 and 2 (i.e., the interval between the waveguides 3 and 4) is 4.1 millimeters.

Figure 8:
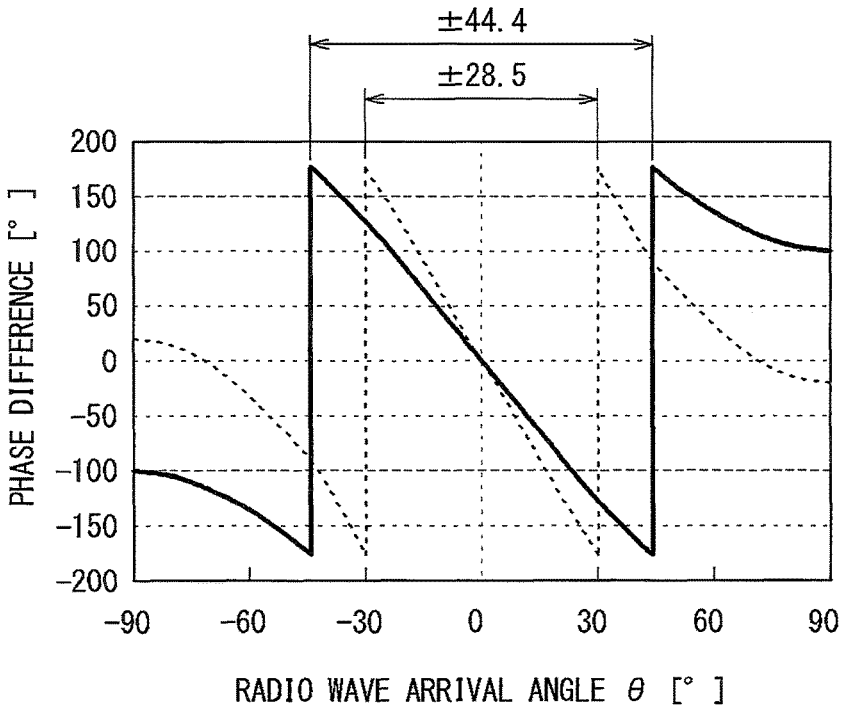
FIG. 8 is a graph showing a relationship between the phase difference between antenna elements and a radio wave arrival angle.

As a conventional example, in the case where the antenna elements 91 and 92 are disposed at the same interval D2 as the interval D1 (D2=4.1 millimeters) as shown in FIG. 12, according to a relational expression shown in the following formula (1), the range of the phase folding angle is ±28.5 degrees. The relational expression shown in the formula (1) indicates a relationship between a folding angle $\theta$, the wavelength $\lambda$ of the radio wave to be used, and the interval D2. FIG. 8 shows a graph showing a relationship between the phase difference between the two antenna elements 10 and 20 (91 and 92) and a radio wave arrival angle $\theta$, in which a graph in the case of D2=4.1 millimeters is shown by a broken line.

[Math. 1]

$$\sin\theta = \frac{\lambda}{2} \times \frac{1}{D2} \tag{1}$$

In contrast, as an example (see FIG. 2), although the interval D1 between the converters 1 and 2 is 4.1 millimeters, when the interval D2 between the antenna elements 10 and 20 is set to 2.8 millimeters by the bend portions 14 and 24 (D2=2.8 millimeters), according to the relational expression shown in the above formula (1), the range of the phase folding angle is ±44.4 degrees. In FIG. 8, a graph in the case of D2=2.8 millimeters is shown by a solid line.

Figure 9:
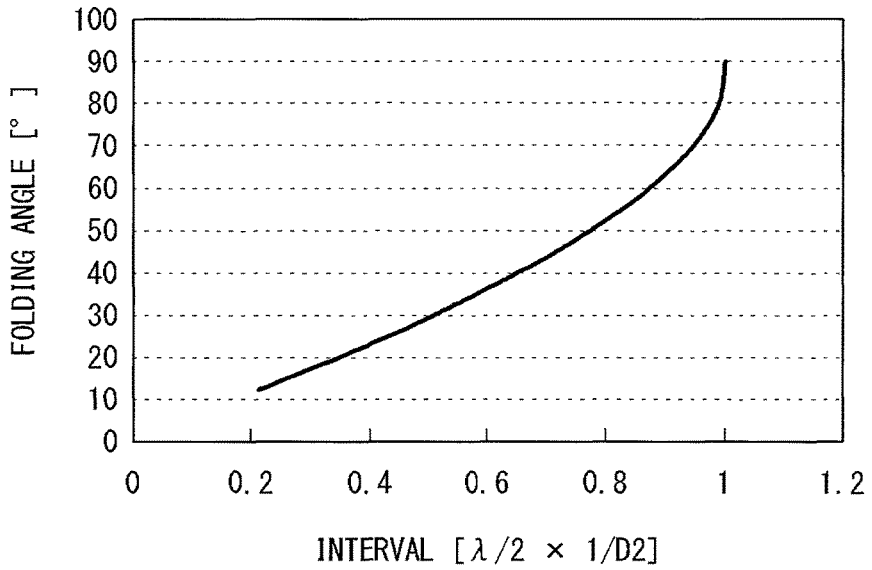
FIG. 9 is a graph showing a relationship between a folding angle, the wavelength of a radio wave to be used, and an antenna element interval.

FIG. 9 is a graph showing a relationship between the folding angle, the wavelength λ, and the interval D2. According to FIG. 9, in the case of D2=λ/2, the folding angle is ±90 degrees, and in the case of D2=λ, the folding angle is ±30 degrees. According to the graph of FIG. 9 and the relational expression shown in the above formula (1), it is recognized that the range of the folding angle θ widens as the interval D2 decreases.

As described above, it is possible to reduce the interval D2 between the first antenna element 10 and the second antenna element 20 by the bend portions 14 and 24, and by reducing the interval D2, it is possible to widen the range of the phase folding angle to widen the detection angle range.

[Regarding Principle of Detecting Arrival Angle of Reflected Wave by Monopulse Method]

Figure 10:
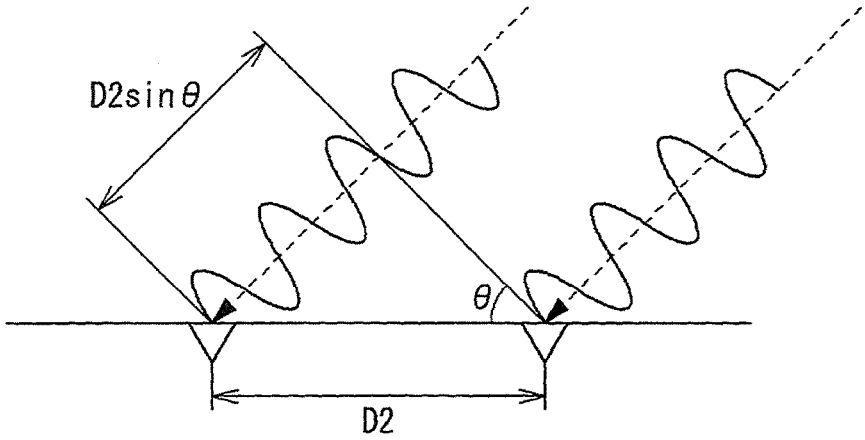
FIG. 10 is a diagram for explaining the principle of a monopulse method.
Figures 11A, 11B, 11C, 11D:
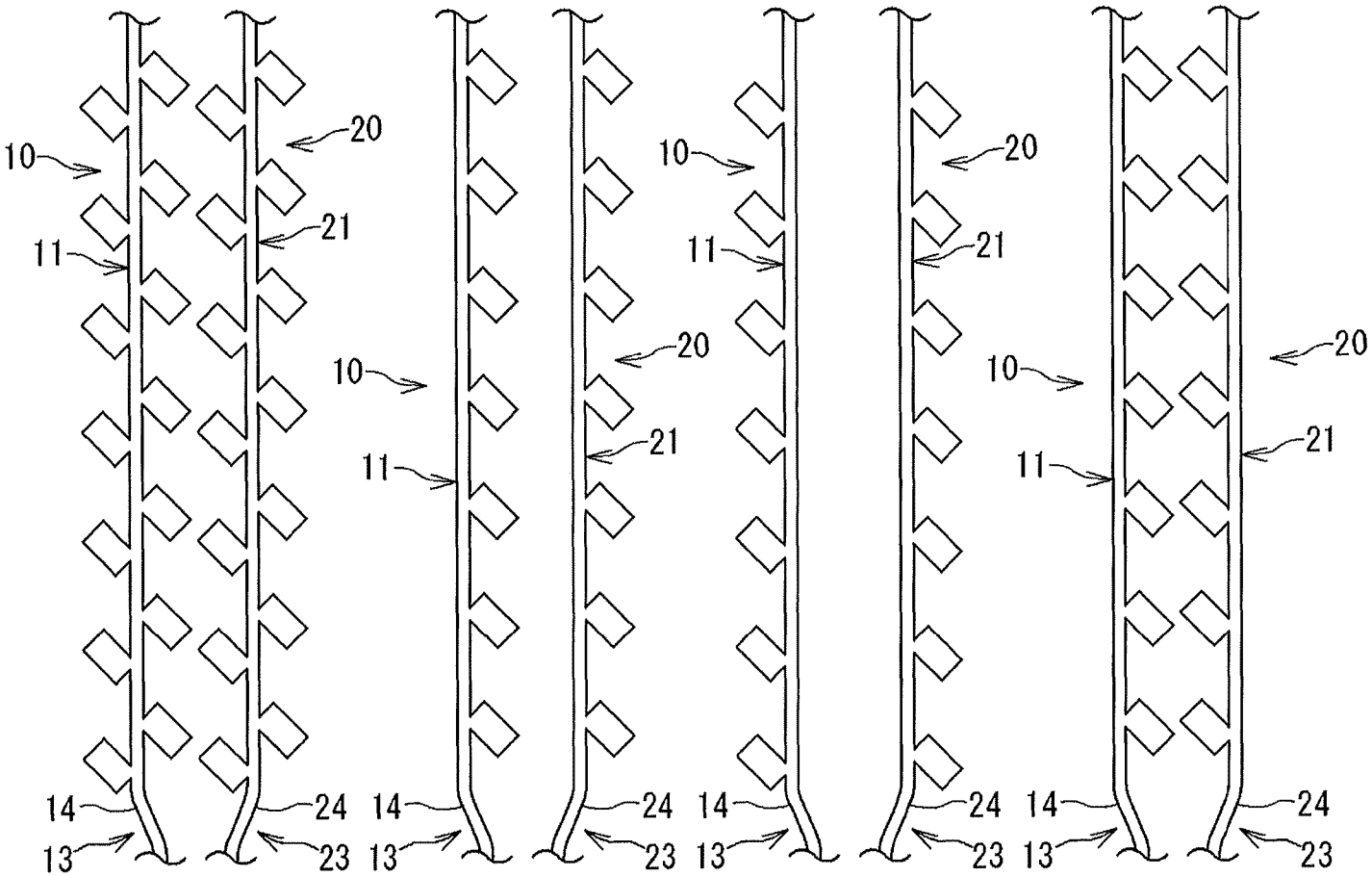
FIGS. 11A to 11D are each an explanatory diagram of a receiving antenna of a reference invention.

The monopulse method is a method in which, for example, as shown in FIG. 1, the two antenna elements 10 and 20 are aligned, the phase difference ϕ between arriving radio waves (reflected waves) received by the antenna elements 10 and 20 is obtained by calculation. FIG. 10 is a schematic diagram for explaining the principle of the monopulse method (phase monopulse angle measurement).

The phase difference ϕ (ϕ2−ϕ1) between the arriving radio waves (reflected waves) received by the antenna elements 10 and 20 can be represented by the following formula (2). In the formula (2), λ indicates the wavelength of the radio wave to be used, D2 indicates the interval (phase center interval) between the antenna elements 10 and 20, and θ indicates the arrival angle of the radio wave (the azimuth angle at which the radio wave arrives). It is possible to obtain an azimuth angle θ, which is the arrival angle of the radio wave, on the basis of the detected phase difference ϕ by using this formula.

[Math. 2]

$$\text{Phase difference } \varphi = \frac{D2 \cdot \sin\theta}{\lambda} \tag{2}$$

[Appended Note 1]

The receiving antenna of the present invention is not limited to the illustrated embodiments and may be another embodiment within the scope of the present invention. For example, the shapes of the radiating elements 12 and 22 may be shapes other than the illustrated shapes.

In each embodiment described above, the case of the receiving antenna including a pair of the antenna elements 10 and 20 as a set has been described, but the receiving antenna of the present invention may include a plurality of sets of antenna elements 10 and 20 each of which sets is a pair of antenna elements 10 and 20.

[Appended Note 2]

FIGS. 11A to 11D are each an explanatory diagram of a receiving antenna of a reference invention. The first antenna element 10 and the second antenna element 20 of the receiving antenna of the present invention (e.g., see FIG. 2) include, at the partial line portions 13 and 23 in the feeder lines 11 and 21, the bend portions 14 and 24 which are bent in the directions in which the bend portions 14 and 24 come close to each other.

In contrast, the first antenna element 10 and the second antenna element 20 of the receiving antenna (reference invention) shown in each of FIGS. 11A to 11D include, at the partial line portions 13 and 23 in the feeder lines 11 and 21, bend portions 14 and 24 which are bent in directions in which the bend portions 14 and 24 are spaced apart from each other. In the cases of FIGS. 11A to 11D, it is possible to configure a receiving antenna having an antenna element interval (D2) which is different from an interval (D1) between converters which are not shown.

The foregoing detailed description has been presented for purposes of illustration and description. It is not intended to be exhaustive or to limit the technology to the precise form disclosed. Many modifications and variations are possible in light of the above teaching. The described embodiments were chosen in order to best explain the principles of the technology and its practical application to enable others skilled in the art to best utilize it in various embodiments and with various modifications as suited to the particular intended use and design considerations at issue. The scope of the technology should be defined only by the claims appended to this description.

REFERENCE SIGNS LIST

1 first converter
2 second converter
3 waveguide
4 waveguide
10 first antenna element
11 feeder line
12 radiating element
13 partial line portion
14 bend portion
15 linear line portion
20 second antenna element
21 feeder line
22 radiating element
23 partial line portion
24 bend portion
25 linear line portion
C central point
L virtual line

What is claimed is:

1. An antenna comprising:

a first antenna element including:

a feeder line extending from a first converter and including a partial line portion; and a plurality of radiating elements which are fed with power from the feeder line; and a second antenna element including:

a feeder line extending from a second converter aligned together with the first converter and including a partial line portion; and a plurality of radiating elements which are fed with power from the feeder line, wherein the first converter is a feeding point for the feeder line of the first antenna element, wherein the second converter is a feeding point for the feeder line of the second antenna element, wherein the first antenna element and the second antenna element respectively include, at the respective partial line portions of the feeder lines that extend from the first and second converters, respectively, to the radiating elements that are respectively closest to the first and second converters, a bend portion which is bent in a direction in which the respective bend portions come close to each other, wherein the partial line portion of the first antenna element and the partial line portion of the second antenna element are disposed so as to be linearly symmetrical about a virtual line, the virtual line passing through a central point between the first converter and the second converter and the virtual line being parallel to a line extension direction, wherein the feeder line of the first antenna element further includes a linear line portion extending linearly from the partial line portion of the first antenna element; the plurality of radiating elements of the first antenna element being disposed at one side or both sides of the linear line portion, wherein the feeder line of the second antenna element further includes a linear line portion extending linearly from the partial line portion of the second antenna element, the plurality of radiating elements of the second antenna element being disposed at one side or both sides of the linear line portion of the second antenna element, and wherein an interval between the linear line portion of the first antenna element and the linear line portion of the second antenna element is smaller than an interval between the first converter and the second converter.

2. The antenna according to claim 1, wherein in each of the first antenna element and the second antenna element, the plurality of radiating elements are disposed at both sides of the linear line portion which extends linearly from the partial line portion, and the radiating elements are disposed such that, if the linear line portion of the first antenna element and the linear line portion of the second antenna element are overlapped with each other, the plurality of radiating elements of the first antenna element and the plurality of radiating elements of the second antenna element coincide with each other.

3. The antenna according to claim 1, wherein in each of the first antenna element and the second antenna element, the plurality of radiating elements are disposed at one side of the linear line portion which extends linearly from the partial line portion, and the radiating elements are disposed such that, if the linear line portion of the first antenna element and the linear line portion of the second antenna element are overlapped with each other, the plurality of radiating elements of the first antenna element and the plurality of radiating elements of the second antenna element coincide with each other.

4. The antenna according to claim 1, wherein in the first antenna element, the plurality of radiating elements are disposed at one side of the linear line portion extending linearly from the partial line portion which side is a side away from the second antenna element, and in the second antenna element, the plurality of radiating elements are disposed at another side of the linear line portion extending linearly from the partial line portion which side is a side away from the first antenna element.

5. The antenna according to claim 1, wherein in the first antenna element, the plurality of radiating elements are disposed at one side of the linear line portion extending linearly from the partial line portion which side is a side close to the second antenna element, and in the second antenna element, the plurality of radiating elements are disposed at another side of the linear line portion extending linearly from the partial line portion which side is a side close to the first antenna element.

6. The antenna according to claim 1, wherein in at least one of the first and second antenna elements, a bending angle of the feeder line at the bend portion is not greater than 75 degrees.

7. The antenna according to claim 2, wherein in at least one of the first and second antenna elements, a bending angle of the feeder line at the bend portion is not greater than 75 degrees.

8. The antenna according to claim 3, wherein in at least one of the first and second antenna elements, a bending angle of the feeder line at the bend portion is not greater than 75 degrees.

9. The antenna according to claim 4, wherein in at least one of the first and second antenna elements, a bending angle of the feeder line at the bend portion is not greater than 75 degrees.

10. The antenna according to claim 5, wherein in at least one of the first and second antenna elements, a bending angle of the feeder line at the bend portion is not greater than 75 degrees.

* * * * *